US005894269A

United States Patent [19]

Takai et al.

[11] Patent Number: 5,894,269

[45] Date of Patent: Apr. 13, 1999

[54] THEFT MONITORING APPARATUS

[75] Inventors: Daisuke Takai; Shin Kinouchi; Hiroaki Takahashi; Nobuyuki Ichimiya; Hitoshi Nakamura, all of Miyagi-ken, Japan

[73] Assignee: Alps Electric Co., Ltd., Tokyo, Japan

[21] Appl. No.: 08/976,243

[22] Filed: Nov. 21, 1997

[30] Foreign Application Priority Data

Nov. 22, 1996 [JP] Japan ..... 8-327939

[51] Int. Cl.[6] ..... G08B 13/14

[52] U.S. Cl. ..... 340/572.2; 340/572.1; 340/568.1

[58] Field of Search ..... 340/571, 572, 340/568, 825.54, 825.49, 568.1, 568.2, 568.5, 572.1, 572.2, 572.4, 572.5, 572.7, 539

[56] References Cited

U.S. PATENT DOCUMENTS 5,353,011 10/1994 Wheeler et al. ..... 340/556
5,519,381 5/1996 Marsh et al. ..... 340/572
5,589,819 12/1996 Takeda ..... 340/571
5,684,828 11/1997 Bolan et al. ..... 340/825.54
5,686,902 11/1997 Reis et al. ..... 340/825.54
5,726,630 3/1998 Marsh et al. ..... 340/572

FOREIGN PATENT DOCUMENTS 08212467 8/1996 Japan .

*Primary Examiner*—Jeffery A. Hofsass
*Assistant Examiner*—Van T. Trieu
*Attorney, Agent, or Firm*—Brinks Hofer Gilson & Lione

[57] ABSTRACT

A theft monitoring apparatus does not require any complicated synchronous relationship for the signals received from a plurality of antennas, permits easier installation and maintenance and inspection, and does not adversely affect the appearance of a shop where it is installed. A plurality of antennas (1, 2) send out transmitter signals composed of burst signals (A, B) which continue in predetermined cycles (T1, T2). The transmitter signal from one antenna (antenna 2) except other antenna (antenna 1) is provided with a pause period (D) during which no burst signal (B) is issued. During the pause period (D), the burst signal (A) is issued from the antenna (1).

9 Claims, 4 Drawing Sheets

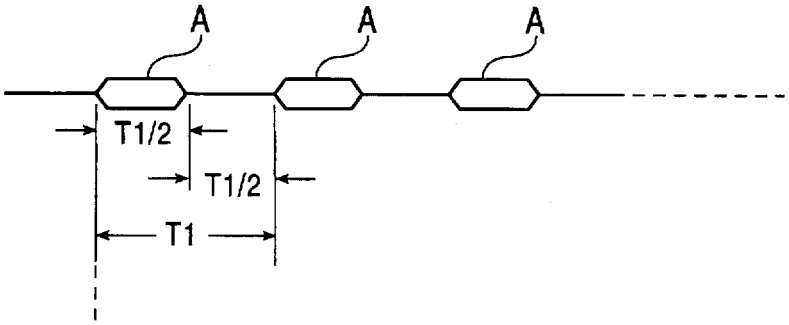
FIG. 7A
PRIOR ART
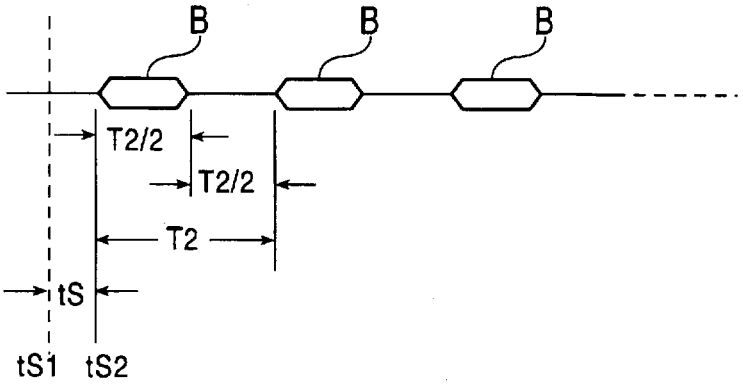
FIG. 7B
PRIOR ART
FIG. 8 PRIOR ART
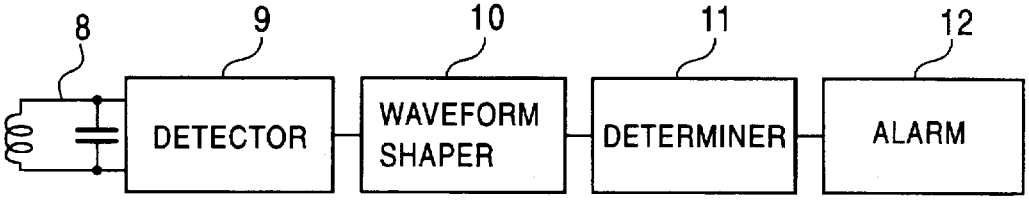
FIG. 9 PRIOR ART
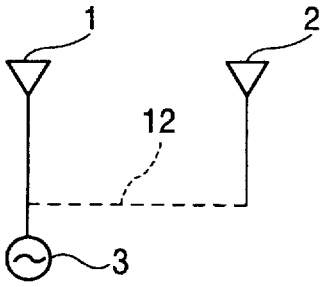

THEFT MONITORING APPARATUS

BACKGROUND OF THE INVENTION

1. Field of the Invention

The present invention relates to a theft monitoring apparatus for protecting merchandise displayed in a shop from shoplifters.

2. Description of Related Art

This type of theft monitoring apparatus includes an antenna for transmitting signals of a specific frequency which is installed at the vicinity of a doorway of a shop, and a receiver for receiving the signals of the specific frequency from the antenna. The receiver, which is referred to as a "tag," is attached beforehand to the merchandise displayed in the shop; if a shoplifter attempts to carry any commodity with the tag out of the shop, then the receiver attached to the commodity detects the signals from the antenna and activates an alarm buzzer or the like to issue warning sound when the shoplifter passes through the doorway. This type of theft monitoring apparatus, however, has been posing a problem in that, if the displayed merchandise includes television sets, personal computers, etc., then the noises emitted from television sets or personal computers unwantedly trigger the receivers attached to the merchandise. To solve the problem, the level of the signal transmitted from the antenna has been set to a relatively higher value than that of the noises, thereby increasing the signal-to-noise ratio.

In recent years, the size of the doorways of shops has been increasing with the increasing size of the shops themselves. With this trend, a plurality of antennas have been installed to cope with the need for expanded areas at the doorways where the commodities can be detected. There is limitation in coping the aforesaid problem by improving the signal-to-noise ratio because the intensity or the like of the signals to be transmitted is limited. There has been proposed a method for measuring the frequency of the signal to be transmitted. A conventional theft monitoring apparatus which includes a plurality of antennas installed to detect the frequency of a transmitted signal will be explained in conjunction with FIG. 5 through FIG. 9.

FIG. 5 is a conceptual diagram illustrating the transmitting unit of a conventional theft monitoring apparatus; FIG. 6 is a block diagram showing a transmitter; FIG. 7 is a diagram illustrating the waveform of a signal transmitted from an antenna of the transmitting unit; FIG. 8 is a block diagram illustrating a receiver; and FIG. 9 is another conceptual diagram illustrating the transmitting unit. In this example, a case wherein two antennas are installed will be explained.

In FIG. 5, antennas 1 and 2 of the transmitting unit are installed, for example, at both sides of a doorway of a shop. Transmitters 3 and 4 are connected to the feeders, not shown, of the antennas 1 and 2, respectively. The transmitters 3 and 4 share the same configuration; they have a signal generator 5, a timing controller 6, and a driver 7 as shown in FIG. 6. The signal generator 5 has a sine wave oscillator circuit (not shown) which oscillates at a frequency of 64 kHz (hereinafter referred to as "carrier wave"). The oscillation signal issued from the signal generator 5 is supplied intermittently to the driver 7 by a control signal generated by the timing controller 6, then it is amplified as necessary by the driver 7 before it is emitted through the antenna 1 or 2. The control signal generated by the timing controller 6 is composed of, for example, successive pulses which have a nominal repetition frequency of 1000 Hz and which turn ON/OFF at a 50% duty cycle (hereinafter referred to as "modulated wave"); during the ON period, the carrier wave issued from the signal generator 5 is supplied to the driver 7 and emitted in a burst mode through the antennas 1 or 2, whereas during the OFF period, the carrier wave is not applied to the driver 7, so that it is not emitted through the antennas 1 or 2. The carrier wave of 64 kHz radiated through the antennas during the ON period of the modulated wave is referred to as a "burst signal."

FIG. 7A illustrates the waveform of the signal which is, for example, transmitted from the antenna 1, and FIG. 7B illustrates the waveform of the signal transmitted from the antenna 2. In this diagram, T1 indicates the period of time of one cycle which is determined by the repetition frequency 1000 Hz of the modulated wave; in a half cycle (T1/2), the carrier wave is radiated for about 16 cycles and turns into the burst signal A. The period during which the burst signal A is radiated corresponds to the ON period of the modulated wave. Likewise, in the case shown in FIG. 7B, a burst signal B is radiated in a half cycle (T2/2). Thus, the burst signal A or B is transmitted in succession in the cycle T1 or T2; however, since the transmitters 3 and 4 are provided separately, the cycles T1 and T2 do not necessarily fully coincide, and the frequencies of the carrier wave (64 kHz) in the burst signals A and B do not necessarily fully coincide, either. Furthermore, times ts1 and ts2 at which the burst signals A and B rise or start, respectively, do not completely agree; there is usually a time difference ts.

The receiver is constituted by a receiving antenna 8 making up a resonance circuit, a detector 9, a waveform shaper 10, a determiner 11, and an alarm 12 as shown in FIG. 8. The receiving antenna 8 receives the transmitter signals shown in FIG. 7A and FIG. 7B, and amplifies them as necessary before detecting them so as to envelope-detect the carrier waves of the burst signals A and B shown in FIGS. 7A and 7B, thereby extracting the modulated wave of the 1000 Hz repetition frequency. The modulated wave is then supplied to the waveform shaper 10 which shapes it into complete pulses. The determiner 11 determines that the received signal is the modulated wave of the 1000 Hz repetition frequency from the half cycle (T1/2) or (T2/2) during the ON period of the pulse, thereby actuating the alarm 12 to issue the warning sound.

FIG. 9 is a conceptual diagram showing the transmitting unit of another conventional example which has only one transmitter. The transmitter signals sent from the antennas 1 and 2 have only the waveform illustrated in FIG. 7A, and the frequencies and phases (accordingly the cycles) of the carrier waves and the modulated waves are completely identical. There is no difference in the rising time of the burst signals; however, a cable 12 is required to interconnect the antennas 1 and 2.

In the case of the theft monitoring apparatus shown in FIG. 5, the burst signal A or B present in the period of the half cycle (T1/2) or (T2/2) is received, and the transmitter signals sent out from the antennas 1 and 2 are set at a high level; therefore, the theft monitoring apparatus is unlikely to be accidentally actuated by the noises of personal computers, etc. Further, if a commodity with a tag attached thereto is passed in the vicinity of either the antenna 1 or 2, e.g. the antenna 1, then the transmitter signal level of the other antenna, e.g. the antenna 2, which is farther from the commodity is lower, enabling only the transmitter signal of a higher level transmitted from the nearby antenna 1 to be received; hence, no problem arises.

If, however, the commodity with the tag thereon is passed at the midpoint between the two antennas 1 and 2, then the receiver receives the transmitter signals of approximately the same level from the two antennas 1 and 2. In such a case, the carrier waves received by the receiver are likely to interfere with each other to cancel their levels and disable the tag, because the transmitter signals sent out from the antennas 1 and 2 do not necessarily coincide phase-wise as mentioned above, that is, the cycles T1 and T2, the half cycles (T1/2) and (T2/2) during which the burst signals A and B are present, the start time ts1 and ts2, and the frequencies of the carrier waves in the burst signals A and B do not always agree. If the burst signal A from the antenna 1 is fully shifted by a half cycle time-wise from the burst signal B from the antenna 2 and the carrier waves are radiated in succession, then even if the carrier waves are received by the receiver, the determiner will not be able to identify the modulated wave of the 512 Hz repetition frequency after detecting them.

The problem mentioned above would be solved by making the carrier wave and the modulated wave of the transmitter 3 connected to the antenna 1 completely synchronized with the carrier wave and the modulated wave of the transmitter 4 connected to the antenna 2; however, doing so would complicate the configuration of the transmitters and add to the cost of the entire apparatus. The system shown in FIG. 9 does not have such a problem since it has only one transmitter 3; however, it would require the cable 12 for connecting the antennas 1 and 2 to be extended in a large shop, making it disadvantageous in the aspect of the installation of the system, the appearance, or the maintenance and inspection after installation.

SUMMARY OF THE INVENTION

The present invention has been made with a view toward solving the problems set forth above, and it is an object of the present invention to provide a theft monitoring apparatus which does not require any complicated synchronous relationship for the transmitter signals sent out from a plurality of antennas, which permits easy installation, maintenance and inspection, and which does not adversely affect the appearance of the shop where it is installed.

To this end, according to the present invention, there is provided a theft monitoring apparatus which sends out transmitter signals composed of burst signals continuing in a determined cycle from a plurality of antennas, provides the transmitter signals from the antennas except one antenna with a pause period wherein the foregoing burst signals are not issued, and sends out the burst signals from the foregoing one antenna during the pause period.

In a preferred form of the present invention, each of the plurality of antennas in the theft monitoring apparatus is equipped with a transmitter, and the respective transmitters transmit the burst signals to the plurality of antennas in the same predetermined cycle.

In another preferred form of the present invention, the theft monitoring apparatus is provided with a receiver for receiving the transmitter signals from the plurality of antennas, wherein the receiver receives a predetermined number of the burst signals.

In yet another preferred form of the theft monitoring apparatus according to the present invention, the number of the burst signals of the transmitter signals from the aforesaid one antenna which are sent out during the pause period are set to the foregoing predetermined number or more.

In a further preferred form of the theft monitoring apparatus according to the present invention, the transmitter signal sent out from the aforesaid one antenna is provided with a pause period wherein the burst signals are not sent out.

In a yet further preferred form of the theft monitoring apparatus according to the present invention, two antennas are provided as the aforesaid plurality of antennas, and the transmitter signal from that particular one antenna is constituted by a first transmission period wherein sixteen burst signals are issued in the predetermined cycle and a first pause period wherein no such burst signal is issued for 48 predetermined cycles following the first transmission period, whereas the transmitter signal from the other antennas is constituted by a second transmission period wherein 24 burst signals are issued in the predetermined cycle and a second pause period wherein no such burst signal is issued for 40 predetermined cycles following the second transmission period.

BRIEF DESCRIPTION OF THE DRAWINGS

FIG. 7A and FIG. 7B are diagrams showing the waveforms of the transmitter signals of the conventional theft monitoring apparatus;

FIG. 8 is a block diagram showing the receiver of another conventional theft monitoring apparatus; and FIG. 9 is a conceptual diagram showing the transmitting unit of the conventional theft monitoring apparatus.

DESCRIPTION OF THE PREFERRED EMBODIMENTS

Figure 1:
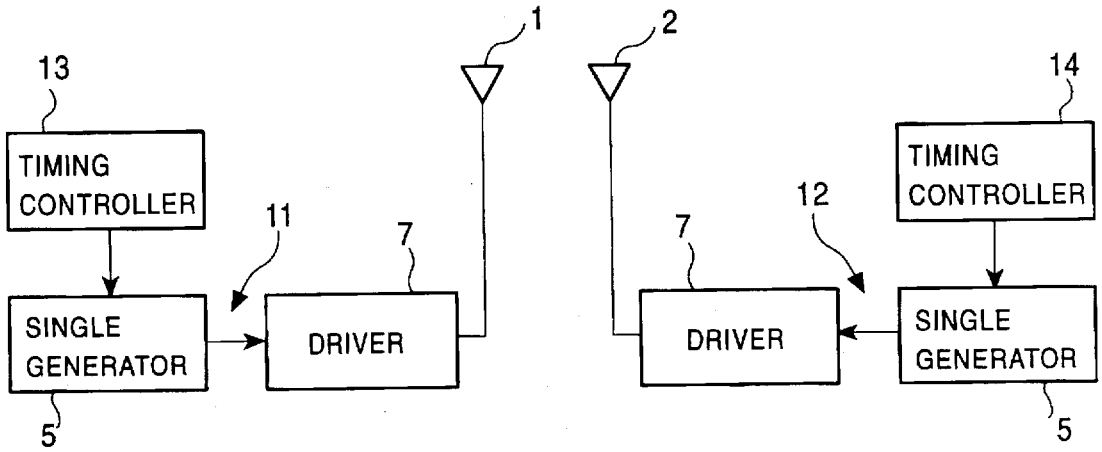
FIG. 1 is a block diagram showing the transmitting unit of a theft monitoring apparatus in accordance with the present invention.
Figure 2A:
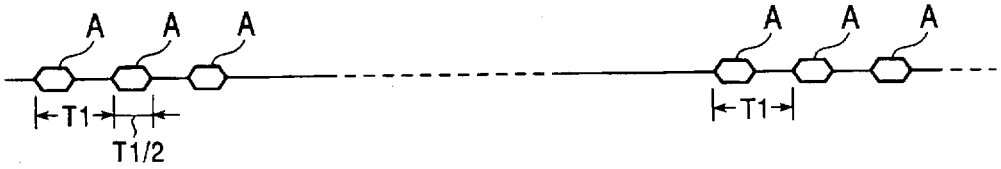
FIG. 2A and FIG. 2B are diagrams showing the waveforms of the transmitter signals of the theft monitoring apparatus in accordance with the present invention.
Figure 2B:
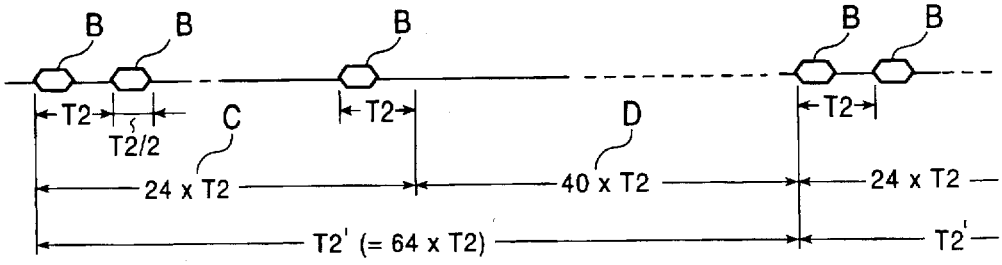
Figure 3:
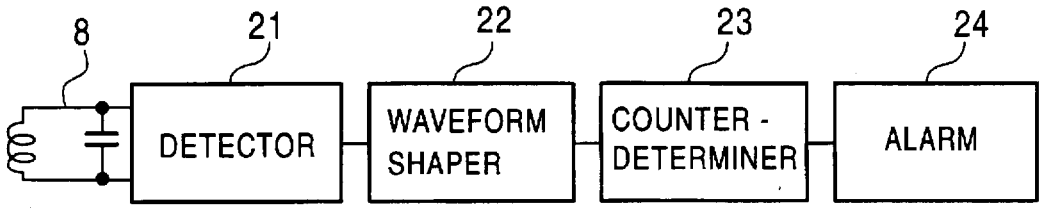
FIG. 3 is a block diagram showing the receiver of the theft monitoring apparatus in accordance with the present invention.
Figure 4A:
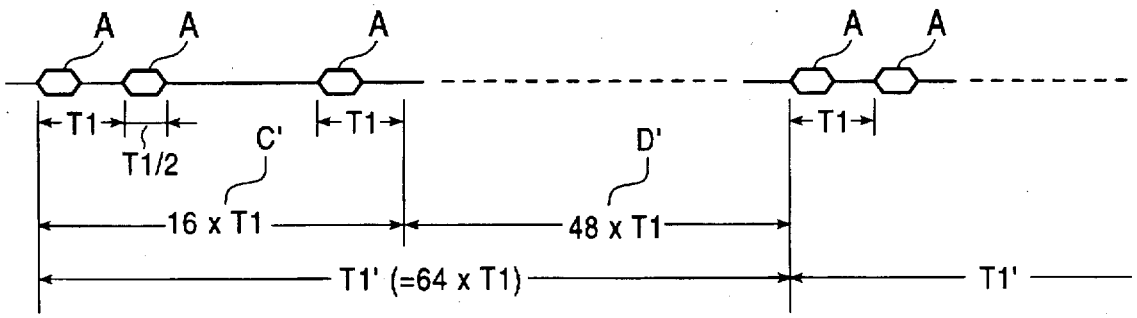
FIG. 4A and FIG. 4B are diagrams showing modification examples of the waveform of the transmitter signal of the theft monitoring apparatus in accordance with the present invention.
Figure 4B:
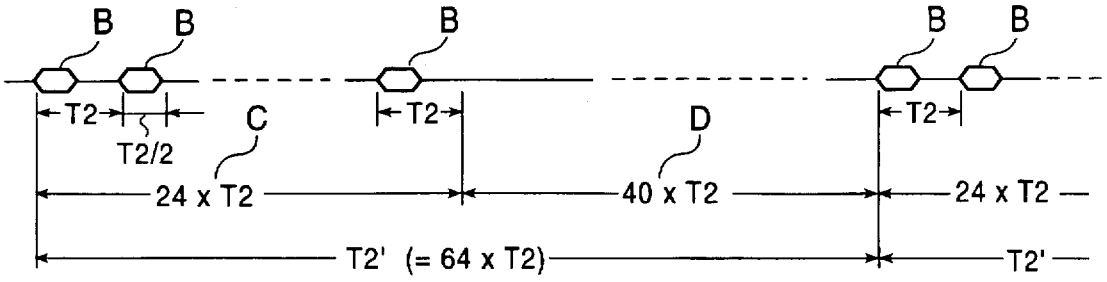
Figure 5:
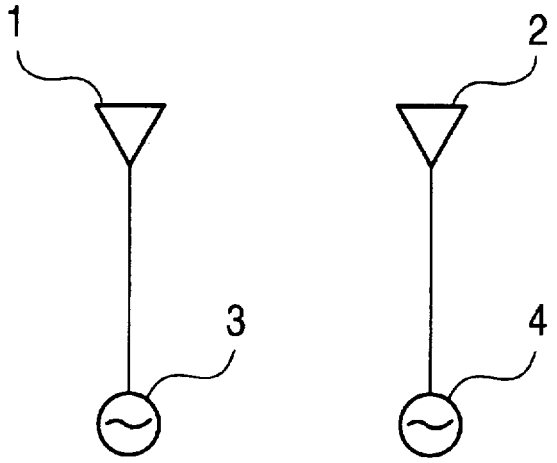
FIG. 5 PRIOR ART
FIG. 5 is a conceptual diagram showing the transmitting unit of a conventional theft monitoring apparatus.

An embodiment of the theft monitoring apparatus in accordance with the present invention will now be explained in conjunction with FIG. 1 through FIG. 4. FIG. 1 is a block diagram showing a transmitter; FIG. 2A and FIG. 2B are diagrams showing the waveforms of transmitter signals sent out from the transmitter; FIG. 3 is a block diagram showing a receiver; and FIG. 4A and FIG. 4B are diagrams showing modification examples of the waveforms of the transmitter signals sent out from the transmitter. In these drawings, like reference numerals will be assigned to like components found in the conventional theft monitoring apparatuses.

Figure 6:
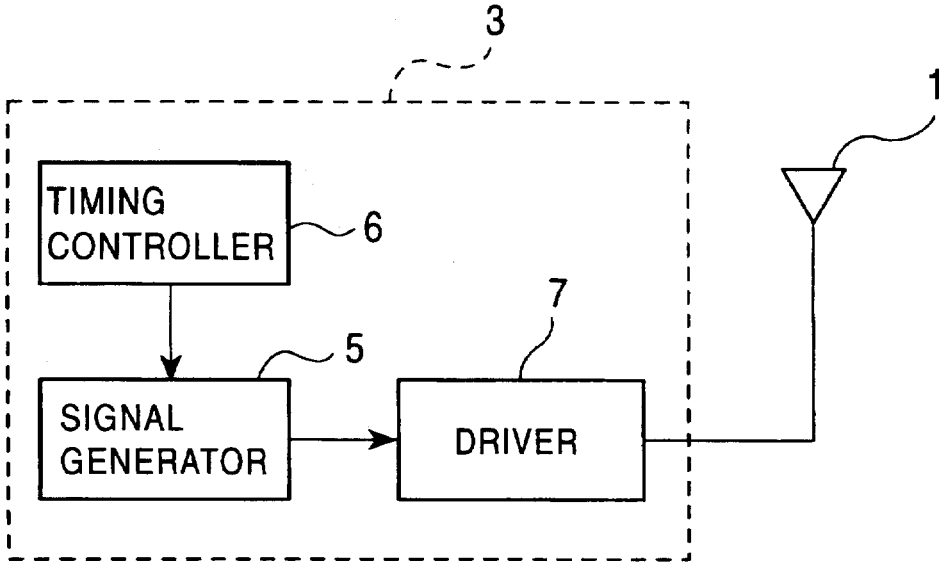
FIG. 6 PRIOR ART
FIG. 6 is a block diagram showing the receiver of the conventional theft monitoring apparatus.

In FIG. 1, transmitter signals are separately sent out from transmitters 11 and 12 to antennas 1 and 2, respectively. The transmitters 11 and 12 have signal generators 5 and drivers 7 which share the same configurations; they are also equipped with timing controllers 13 and 14. The timing controller 13 of the transmitter 11 has almost the same configuration as that of a timing controller 6 of a conventional transmitter 3 shown in FIG. 6; more specifically, it issues pulses which are modulated waves that have a repetition frequency of 1000 Hz and that turn ON/OFF at a 50% duty and it intermittently sends out carrier waves of 64 kHz from the signal generator 5 to the driver 7. As a result, as in the case of the waveform shown in FIG. 7A, the antenna 1 sends out a transmitter signal like the one shown in FIG. 2A wherein a burst signal A of a half cycle (T1/2) is generated in succession in a cycle of T1.

The timing controller 14 of the other transmitter 12 first issues pulses of a modulated wave that have a repetition frequency of 1000 Hz and that turn ON/OFF at a 50% duty such that the pulses continue for 24 cycles, for example, then the pulses are turned OFF for a period corresponding to 40 cycles. Hence, the timing controller 14 issues the signals so that 64 cycles of the repetition frequency of 1000 Hz (refer to T2' shown in FIG. 2B) form a new one cycle. Thus, the antenna 2 outputs a burst signal B continuously for 24 cycles at intervals of T2 as illustrated in FIG. 2B. This period denoted as C is referred to as a burst signal transmitting period (hereinafter referred to simply as "transmission period"). Accordingly, 24 burst signals are sent out during the transmission period C. After that, the period wherein no burst signal is issued follows for 40 cycles. This period denoted as D is referred to as a burst signal pause period (hereinafter referred to simply as "pause period"). Incidentally, T1 and T2 respectively indicate approximately one millisecond; therefore, the new one cycle based on the sum of the transmitting period C and the pause period D is approximately 64 milliseconds which is equivalent to 64 cycles in terms of T1 and T2.

FIG. 3 shows the configuration of the receiver which receives the aforesaid two types of transmitter signals. The transmitter signals are received through a receiving antenna 8 which is tuned to 64 kHz, and the received signals are detected through a detector 21 to take out the modulated wave component of 1000 Hz. For the detection, a publicly known method including an envelope detection may be employed. The detection output is supplied to a waveform shaper 22 which shapes the waveform thereof, thus making it possible to reproduce the pulses which turn ON/OFF at the same 50% duty as that of the modulated wave supplied from the timing controller 13 or 14 to the signal generator 5. Hence, when the transmitter signals from the antenna 1 are received, the waveform shaper 22 provides the pulses of the 1000-Hz repetition frequency and the 50% duty; or when the transmitter signals from the antenna 2 are received, the waveform shaper 22 provides the pulses which have the 1000-Hz repetition frequency and which turn ON/OFF at the 50% duty in succession for 24 cycles, then issues no pulse for 40 cycles. A counter-determiner 23 first counts the pulses received from the waveform shaper 23; it counts only the pulses that turn ON/OFF in the half cycle (T1/2) or (T2/2); in actual operation, the counter-determiner 23 counts the pulses by regarding T1 and T2 as the same T. Therefore, the waveforms obtained from the noises received from a personal computer or the like do not display the repetitious pulses of the cycle T, so that the counter-determiner 23 ignores them.

The counter-determiner 23 is provided with a register, not shown, and a predetermined count value, e.g. data 1, 1 indicating 4, is set in the register beforehand, so that an output pulse is issued when four pulses of the modulated wave have been received in succession. When the output pulse is issued, a warning sound is given by the buzzer or the like of an alarm 24.

In the theft monitoring apparatus having the configuration explained above, if a commodity with a tag attached thereto is passed in the vicinity of the antenna 1 or the antenna 2, then the transmitter signal from the antenna 1 or the antenna 2 can be detected as in the conventional apparatus, posing no problem since the transmitter signal from the farther antenna has a lower level and cannot be received. Even when the commodity is passed at the midpoint between the two antennas 1 and 2, only the transmitter signal from the antenna 1 out of the transmitter signals from both antennas 1 and 2 can be securely received without the problem of mutual interference as set forth below.

The basic repetition frequencies of the timing controllers 13 and 14 are both set to 1000 Hz; however, since the timing controllers are provided independently, they have no synchronous relationship, and the repetition frequencies do not necessarily coincide completely. The transmitter signal from the antenna 1 continuously provides the burst signal A. On the other hand, the transmitter signal from the antenna 2 is provided with the pause period D during which no burst signal B is radiated, so that the successive burst signal A from the antenna 1 always exists during the pause period D. Hence, during the pause period D, there is only the burst signal A among the transmitter signals received from the antenna 1, causing no interference problem. Thus, even when the transmitter signals are received at the midpoint between the two antennas 1 and 2, the transmitter signals from the antenna 1 can be securely received. Furthermore, during the pause period D, the transmitter signal from the antenna 1 generates 40 burst signals A from the 40 repetition cycles, enabling the counter-determiner 23 to securely detect 40 pulses of the 1000-Hz modulated wave. The counted 40 pulses satisfy the count value, namely, four, set in the counter-determiner, thus actuating the alarm 24 without fail.

FIGS. 4A and 4B illustrate modification examples of the waveform of the transmitter signals in the theft monitoring apparatus according to the present invention. As shown in FIG. 4A, the transmitter signal from the antenna 1 is composed of a first transmission period C' during which the burst signal A is sent out for 16 cycles, i.e. 16 burst signals A are sent out, and a first pause period D' during which no burst signal A is sent out for 48 cycles. The other antenna 2 sends out the transmitter signal shown in FIG. 4B which is the same transmitter signal shown in FIG. 2B. More specifically, the transmitter signal from the antenna 2 is composed of a second transmission period C during which the burst signal B is sent out for 24 cycles, i.e. 24 burst signals B are sent out, and a second pause period D during which no burst signal B is sent out for 40 cycles. Thus, the length (16 cycles) of the first transmission period C' of the transmitter signal from the antenna 1 is different from the length (24 cycles) of the transmission period C of the transmitter signal from the antenna 2; likewise, the length (48 cycles) of the first pauses period D' of the transmitter signal from the antenna 1 is different from the length (40 cycles) of the pause period D of the transmitter signal from the antenna 2. In this modification examples also, the timing controllers 13 and 14 are independent from each other and have no synchronous relationship.

Hence, even if there is a slight difference between the repetition frequencies of the modulated waves of nominal 1000 Hz generated by the two timing controllers 13 and 14, or even if the timings of the first burst signals A and B which begin at the completion of the first and second pause periods D' and D are shifted and either burst signal A or B is delayed, there are always four consecutive burst signals B (=(24–16)/2), which are sent out during the second transmission period C of the transmitter signal from the antenna 2, in the first pause period D' of the transmitter signal from the antenna 1. The number, namely, four, of the burst signals corresponds to the number for detecting the four pulses required for the counter-determiner 23 to make judgment.

During the first pause period D', only the burst signals B in the second transmission period C of the transmitter signal from the antenna 2 can be received. Receiving and detecting the burst signal B enables the comparison with the count value, four, preset in the counter-determiner 23, so that accurate judgment can be implemented.

In this example of modification, the new cycle based on the sum of the first transmission period C and the first pause period D of the transmitter signal from the antenna 1 (T1'=64*T1) and the new cycle based on the sum of the second transmission period C' and the second pause period D' of the transmitter signal from the antenna 2 (T2'=64*T2) both have the same period of length which corresponds to 64 repetition cycles of the 1000-Hz modulated wave; however, they are not necessarily required to be the same period of length. It is essential, however, that, during the pause period D' of the transmitter signal from one antenna (e.g. antenna 1), there are not less than the predetermined count value, which has been preset in the counter-determiner 23, of the burst signals B from the other antenna 2. Moreover, in this example of modification, the transmitter signal sent out from one antenna is provided with the pause period wherein no burst signal is issued; therefore, the transmitter signals from all antennas can be provided with the pause periods. This makes it possible to receive a signal indicative of a judgment result from the receiver by making use of the pause periods, thus allowing the transmitter to provide a separate alarm display or the like in response to an activated alarm.

The explanation given so far refers to the case wherein two antennas are installed in a shop; however, even if there are three or more antennas in a shop, the same advantage can be obtained. To be more specific, the transmission period of a burst signal of one antenna is provided with a pause period of another antenna installed in an area where it may interfere with the foregoing particular antenna, and a predetermined number of burst signals from that particular antenna are issued during the foregoing pause period. This makes it possible to receive the transmitter signals from a plurality of antennas without the mutual interference problem, to securely obtain the pulses, i.e. the modulated wave, by detecting the received burst signals, and also to ensure accurate actuation of the alarm by counting the predetermined number of pulses.

Thus, the theft monitoring apparatus in accordance with the present invention sends out transmitter signals composed of burst signals continuing in a determined cycle from a plurality of antennas, provides the transmitter signals from all antennas except one antenna with a pause period wherein the foregoing burst signals are not issued, and sends out the burst signals from the foregoing one antenna during the pause period. Hence, even at the midpoint of a plurality of antennas, the transmitter signals from only one antenna can be received without incurring the mutual interference among the transmitter signals from the plurality of antennas.

Further, each of the plurality of antennas in the theft monitoring apparatus in accordance with the present invention is equipped with a transmitter, and the respective transmitters send out the burst signals to the plurality of antennas in the same predetermined cycle. Hence, the respective transmitters are not required to have a complicated relationship for signal synchronization, and the transmitters may be independently installed to match the positions where the antennas are installed, thus eliminating the need for a cable or the like for interconnecting the antennas.

Furthermore, the theft monitoring apparatus in accordance with the present invention is provided with a receiver for receiving the transmitter signals from the plurality of antennas, wherein the receiver receives a predetermined number of the burst signals. Hence, only the modulated waves contained in the burst signals can be detected without being interfered by the noises from other commodities, permitting accurate actuation of the alarm of the apparatus.

Moreover, in the theft monitoring apparatus according to the present invention, the number of the burst signals of the transmitter signals from the aforesaid one antenna which are sent out during the pause period is set to the foregoing predetermined number or more. Hence, the number of the pulses obtained by the detection by a receiver does not become the count value or less preset in the receiver, thus ensuring accurate judgment in the receiver.

Further, in the theft monitoring apparatus according to the present invention, the transmitter signal sent out from one antenna is also provided with a pause period wherein no such burst signal is sent out. Hence, the transmitter signals from all antennas can be provided with the pause periods, making it possible to receive a signal indicative of a judgment result from the receiver by making use of the pause periods. This allows the transmitter to provide a separate alarm display or the like in response to an activated alarm.

In addition, the theft monitoring apparatus according to the present invention has two antennas, and the transmitter signal from one antenna is constituted by a first transmission period wherein sixteen burst signals are issued in the predetermined cycle and a first pause period wherein no such burst signal is issued for 48 predetermined cycles following the first transmission period, whereas the transmitter signals from the other antenna are constituted by a second transmission period wherein 24 burst signals are issued in the predetermined cycle and a second pause period wherein no such burst signal is issued for 40 predetermined cycles following the second transmission period. This allows a simpler configuration of the theft monitoring apparatus capable of reliable receiving without the interference between the transmitter signals from the two antennas.

What is claimed is:

1. A theft monitoring apparatus, comprising:

a first antenna and a second antenna located apart;

first control means for transmitting a first signal from said first antenna and second control means for transmitting a second signal from said second antenna, each signal being transmitted in one frequency;

said first signal comprising a first plurality of intermittent burst signals defining a first transmitting cycle directly preceding a first pause period, said first pause period being longer than said first transmitting cycle;

said second signal comprising a second plurality of intermittent burst signals defining a second transmitting cycle; and alarm means for identifying the detection of said burst signals in said first and said second signals.

2. A theft monitoring apparatus according to claim 1, comprising a receiver for receiving said first signal transmitted from said first antenna and said second signal transmitted from said second antenna, wherein said receiver receives a predetermined number of said first and said second burst signals.

3. A theft monitoring apparatus according to claim 2, wherein the number of said second burst signals transmitted from said second antenna during said first pause period is set to said predetermined number.

4. A theft monitoring apparatus according to claim 1, wherein said first control means comprises a first transmitter transmitting said first signal and said second control means comprises a second transmitter transmitting said second signal.

5. A theft monitoring apparatus, comprising:

a first antenna and a second antenna located apart;

first control means for transmitting a first signal from said first antenna and second control means for transmitting a second signal from said second antenna, each signal being transmitted in one frequency;

said first signal comprising a first plurality of intermittent burst signals defining a first transmitting cycle directly preceding a first pause period, said first pause period being longer than said first transmitting cycle;

said second signal comprising a second plurality of intermittent burst signals defining a second transmitting cycle directly preceding a second pause period, said second pause period being shorter than said first pause period; and alarm means for identifying the detection of said burst signals in said first and said second signals.

6. A theft monitoring apparatus according to claim 5, wherein said first control means comprises a first transmitter transmitting said first signal and said second control means comprises a second transmitter transmitting said second signal.

7. A theft monitoring apparatus according to claim 5, comprising a receiver for receiving said first signal transmitted from said first antenna and said second signal transmitted from said second antenna, wherein said receiver receives a predetermined number of said first and said second burst signals.

8. A theft monitoring apparatus according to claim 7, wherein the number of said second burst signals transmitted from said second antenna during said first pause period is set to said predetermined number.

9. A theft monitoring apparatus according to claim 5, wherein said first transmitting cycle comprises transmitting sixteen pieces of burst signals, said first pause period comprises the lapse of forty-eight predetermined cycles, said second transmitting cycle comprises transmitting twenty-four pieces of burst signals, and said second pause period comprises the lapse of forty predetermined cycles.

* * * * *